US005958217A

United States Patent [19]

Nacamuli et al.

[11] Patent Number: 5,958,217

[45] **Date of Patent: *Sep. 28, 1999**

[54] TWO-STAGE REFORMING PROCESS THAT ENHANCES PARA-XYLENE YIELD AND MINIMIZES ETHYLBENZENE PRODUCTION

[75] Inventors: Gerald J. Nacamuli, Mill Valley; Roger F. Vogel, Fairfield, both of Calif.

[73] Assignee: Chevron Chemical Company LLC, San Francisco, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/559,525

[22] Filed: Nov. 15, 1995

[51] Int. Cl.[6] ..... C10G 59/02; C10G 35/085; C10G 35/06

[52] U.S. Cl. ..... 208/65; 208/64; 585/321; 585/322

[58] Field of Search ..... 208/64, 65; 585/321, 585/322

[56] References Cited

U.S. PATENT DOCUMENTS

| | | | |
|---|---|---|---|
| 4,098,837 | 7/1978 | Chu | 260/672 |
| 4,159,282 | 6/1979 | Olson et al. | 585/481 |
| 4,163,028 | 7/1979 | Tabak et al. | 585/481 |
| 4,211,886 | 7/1980 | Tabak et al. | 585/321 |
| 4,278,565 | 7/1981 | Chen et al. | 252/455 |
| 4,443,326 | 4/1984 | Field | 208/64 |
| 4,482,773 | 11/1984 | Chu et al. | 585/481 |
| 4,584,423 | 4/1986 | Nacamuli et al. | 585/481 |
| 4,806,230 | 2/1989 | Salusinszky | 208/64 |
| 5,037,529 | 8/1991 | Dessau et al. | 208/64 |
| 5,292,976 | 3/1994 | Dessau et al. | 585/322 |

*Primary Examiner*—Walter D. Griffin
*Attorney, Agent, or Firm*—W. Bradley Haymond

[57] ABSTRACT

A hydrocarbon feed is reformed to enhance para-xylene yield and to minimize ethylbenzene production. The hydrocarbon feed is subjected to catalytic aromatization at elevated temperatures in the presence of hydrogen, using a non-acidic catalyst having at least one Group VIII metal on a non-acidic zeolite support, to produce a reformate stream containing ethylbenzene and xylenes in which the para-xylene content of the xylene fraction is less than equilibrium. Then, at least some of the reformate is reacted at elevated temperatures in the presence of hydrogen, using an intermediate pore size zeolitic catalyst having a modifier in the absence of a Group VIII metal, to isomerize the non-equilibrium xylene fraction. The modifier can be magnesium, calcium, barium, or phosphorus. At least 20 wt. % of the ethylbenzene in the reformate is converted by hydrodealkylation.

9 Claims, No Drawings

TWO-STAGE REFORMING PROCESS THAT ENHANCES PARA-XYLENE YIELD AND MINIMIZES ETHYLBENZENE PRODUCTION

The present invention relates to a two-stage process for reforming a hydrocarbon feed to enhance para-xylene yield and to minimize ethylbenzene production.

BACKGROUND OF THE INVENTION

It is known that a non-acidic zeolite catalyst, such as Pt/K-Ba L-Zeolite or Pt/K L-Zeolite, can be used to reform a wide boiling range naphtha ($C_6$–$C_{10}$). The resulting product would be aromatics, namely benzene, toluene, and $C_8$ and $C_9$ aromatics. The $C_8$ aromatics fraction would normally have a product distribution which contains 30–35% ethylbenzene and 65–70% xylenes. In addition, the xylenes distribution would normally show a para-xylene content well below equilibrium, namely 10–14%.

In contrast, when reforming the same naphtha with a standard reforming bi-metallic catalyst with an acidic function, such as Pt-Re or Pt-Sn on alumina, the $C_8$ aromatics fraction has a product distribution which contains about 15% ethylbenzene and 85% xylenes. As for the xylenes distribution, the para-xylene content is closer to equilibrium, i.e. about 20%. However, in terms of aromatics production, the standard reforming catalyst is much less selective than the non-acidic zeolite, and the overall aromatics yield is much lower.

Thus, while there is an advantage in reforming with a non-acidic zeolite, the high ethylbenzene content of the $C_8$ aromatics fraction and the below equilibrium para-xylene concentration in the xylenes fraction present a distinct disadvantage to a para-xylene producer. This disadvantage means that a bigger para-xylene processing loop is required to handle the higher ethylbenzene content and below para-xylene equilibrium $C_8$ aromatics fraction, which in turn means a processing scheme with higher capital investment and operating costs. In addition,more xylenes will be lost per pass, resulting in a lower para-xylene yield from a given quantity of xylenes. This adds to the higher operating costs.

SUMMARY OF THE INVENTION

The present invention provides a two-stage process for reforming a hydrocarbon feed to enhance para-xylene yield and to minimize ethylbenzene production.

In the first stage, the hydrocarbon feed is reacted at elevated temperatures in the presence of hydrogen, using a catalyst comprising at least one Group VIII metal on an inorganic support, such as a non-acidic zeolite support, to produce a reformate stream containing ethylbenzene and xylenes in which the para-xylene content of the xylene fraction is less than equilibrium. Preferably, the non-acidic catalyst comprises platinum on a non-acidic potassium zeolite L.

In the second stage, at least some of the reformate is reacted at elevated temperatures, using an isomerization catalyst comprising a modifier on an intermediate pore size zeolitic support to isomerize the non-equilibrium xylene fraction, wherein at least 20 wt. % the ethylbenzene in the reformate is converted by hydrodealkylation. The modifier can be magnesium, calcium, barium, or phosphorus. Preferably, the second stage reaction occurs in the presence of hydrogen in the absence of a Group VIII metal.

Preferably, the intermediate pore size zeolitic support is ZSM-5, ZSM-11, ZSM-12, silicalite, or mixtures thereof, most preferably ZSM-5.

Preferably, the modifier on the intermediate pore size zeolitic support is magnesium or phosphorus, more preferably magnesium.

Preferably, the first stage of this reaction is carried out at a temperature of 400° C. to 600° C., a pressure of from 1 atmosphere to 500 psig, a LHSV of from 0.3 to 5, and a $H_2$/HC mole ratio of from 1:1 to 10:1; and the second stage is carried out at a temperature of 400° C. to 600° C., a pressure of from 1 atmosphere to 500 psig, a WHSV of from 5 to 10, and a $H_2$/HC mole ratio of from 1:1 to 10:1.

In one embodiment of the present invention, the hydrocarbon feed is reacted in the presence of hydrogen at a temperature of 430° C. to 550° C., a pressure of from 75 to 100 psig, a LHSV of from 0.3 and 5, and a $H_2$/HC mole ratio of from 2:1 to 5:1, using a non-acidic catalyst comprising platinum on a non-acidic zeolite L, to produce a reformate stream containing ethylbenzene and xylenes in which the para-xylene content of the xylene fraction is less than equilibrium, then at least some of said reformate is reacted in the presence of hydrogen at a temperature of 430° C. to 550° C., a pressure of from 75 to 100 psig, a WHSV of from 5 to 10, and a $H_2$/HC mole ratio of from 2:1 to 5:1, using an isomerization catalyst comprising magnesium on a ZSM-5 support in the absence of a Group VIII metal, to isomerize the non-equilibrium xylene fraction, and wherein at least 20 wt. % of the ethylbenzene in the reformate is converted by hydrodealkylation.

DETAILED DESCRIPTION OF THE INVENTION

In its broadest aspect, the present invention involves a catalytic process for reforming a wide boiling range naphtha in a first stage to make benzene, toluene, and $C_8$–$C_9$ aromatics, then further reacting the effluent from the first stage in a second stage to hydrodealkylate ethylbenzene to benzene, while isomerizing the xylenes from the first stage to yield an equilibrium mixture of xylenes.

REFORMING CATALYSTS

One of the catalysts used must be a non-acidic catalyst having a non-acidic zeolite support charged with one or more dehydrogenating constituents. Among the zeolites useful in the practice of the present invention are zeolite L, zeolite X, and zeolite Y. These zeolites have apparent pore sizes on the order of 7 to 9 Angstroms.

Zeolite L is a synthetic crystalline zeolitic molecular sieve which may be written as:

$$(0.9–1.3)M_{2/n}O:Al_2O_3(5.2–6.9)SiO_2:yH_2O$$

wherein M designates a cation, n represents the valence of M, and y may be any value from 0 to about 9. Preferably, M is potassium. Zeolite L, its X-ray diffraction pattern, its properties, and method for its preparation are described in detail in U.S. Pat. No. 3,216,789. U.S. Pat. No. 3,216,789 is hereby incorporated by reference to show the preferred zeolite of the present invention. The real formula may vary without changing the crystalline structure; for example, the silicon to aluminum mole ratio may vary from 1.0 to 3.5.

Zeolite X is a synthetic crystalline zeolitic molecular sieve which may be represented by the formula:

$$(0.7–1.1)M_{2/n}O:Al_2O_3:(2.0–3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention.

Zeolite Y is a synthetic crystalline zeolitic molecular sieve which may be written as:

$$(0.7–1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

The preferred non-acidic catalyst is a type L zeolite charged with one or more dehydrogenating constituents.

The zeolitic catalysts according to the invention are charged with one or more Group VIII metals, e.g., nickel, ruthenium, rhodium, palladium, iridium or platinum. The preferred Group VIII metals are iridium and particularly platinum, which are more selective with regard to dehydrocyclization and are also more stable under the dehydrocyclization reaction conditions than other group VIII metals.

The preferred percentage of platinum in the dehydrocyclization catalyst is between 0.1% and 5%, more preferably between 0.5–1.5%, the lower limit corresponding to minimum catalyst activity and the upper limit to maximum activity. This allows for the high price of platinum, which does not justify using a higher quantity of the metal since the result is only a slight improvement in catalyst activity.

Group VIII metals are introduced into the large-pore zeolite by synthesis, impregnation or ion exchange in an aqueous solution of the appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion-exchange process, platinum can be introduced by using cationic platinum complexes such as tetrammineplatinum (II) nitrate.

A preferred, but not essential, element of the present invention is the presence of an alkaline earth metal in the dehydrocyclization catalyst. That alkaline earth metal can be either barium, strontium or calcium. Preferably the alkaline earth metal is barium. The alkaline earth metal can be incorporated into the zeolite by synthesis, impregnation or ion exchange. Barium is preferred to the other alkaline earths because the resulting catalyst has high activity, high selectivity and high stability.

An inorganic oxide may be used as a carrier to bind the large-pore zeolite containing the Group VIII metal. The carrier can be a natural or a synthetically produced inorganic oxide or combination of inorganic oxides. Typical inorganic oxide supports which can be used include clays, alumina, and silica, in which acidic sites are preferably exchanged by cations that do not impart strong acidity.

The non-acidic catalyst can be employed in any of the conventional types of equipment known to the art. It may be employed in the form of pills, pellets, granules, broken fragments, or various special shapes, disposed as a fixed bed within a reaction zone, and the feedstock may be passed therethrough in the liquid, vapor, or mixed phase, and in either upward or downward flow. Alternatively, it may be prepared in a suitable form for use in moving beds, or in fluidized-solid processes, in which the feedstock is passed upward through a turbulent bed of finely divided catalyst.

The reforming catalyst can be reduced in the presence of hydrogen at temperatures from 480° C. to 600° C. In addition, the catalyst can be fluorided and chlorided.

REFORMING CONDITIONS

The reforming process is carried out in the presence of hydrogen at a pressure adjusted to favor the dehydrocyclization reaction thermodynamically and to limit undesirable hydrocracking reactions. The pressures used preferably vary from 1 atmosphere to 500 psig, more preferably from 75 to 100 psig.

The molar ratio of hydrogen to hydrocarbons preferably is from 1:1 to 10:1, more preferably from 2:1 to 5:1. The $H_2$/HC ratio is measured at the inlet of the first stage.

In the temperature range of from 400° C. to 600° C., the dehydrocyclization reaction occurs with acceptable speed and selectivity. If the operating temperature is below 400° C., the reaction speed is insufficient and consequently the yield is too low for industrial purposes. When the operating temperature of dehydrocyclization is above 600° C., interfering secondary reactions such as hydrocracking and coking occur, and substantially reduce the yield. It is not advisable, therefore, to exceed the temperature of 600° C. The preferred temperature range (430° C. to 550° C.) of dehydrocyclization is that in which the process is optimum with regard to activity, selectivity and the stability of the catalyst. A typical start-of run temperature is about 455° C.

The liquid hourly space velocity of the hydrocarbons in the dehydrocyclization reaction is between 0.3 and 5.

Reforming a wide boiling range naphtha that contains $C_8$ paraffins with a non-acidic zeolite yields a $C_8$ aromatics fraction that contains about 30 to 35% ethylbenzene and the balance xylenes. In addition, because the zeolite is non-acidic, no xylene isomerization takes place. Thus the xylenes that are produced have a non-equilibrium composition, i.e., the para-xylene content is about 10 to 14% on a xylene basis.

In a typical aromatics processing scheme to produce benzene, toluene and xylenes, the $C_8$ aromatics fraction produced in the reforming stage is recovered and sent to a para-xylene processing loop to produce para-xylene. Since ethylbenzene is an inert, the higher the quantity of ethylbenzene introduced into the para-xylene loop, the bigger the para-xylene loop will have to be in order to handle and convert the ethylbenzene to light and heavy aromatics that can be removed from the para-xylene loop by distillation. In addition, because of the higher volumetric traffic within the para-xylene loop, xylene losses per pass will also be higher thereby reducing the yield of para-xylene from the available xylenes. Furthermore, since the xylenes are not at equilibrium and the concentration of para-xylene on a xylene basis is only about 10 to 14% the para-xylene recovery process (adsorption or crystallization) will have to be larger in order to handle the higher quantity of inerts (meta-xylene, ortho-xylene and ethylbenzene) and still produce the required quantity of para-xylene. Thus the higher ethylbenzene content of the C8 aromatics stream coupled with a below para-xylene equilibrium concentration results in a para-xylene processing facility with a high capital investment and operating cost.

INTERMEDIATE PORE SIZE ZEOLITIC CATALYST

The intermediate pore size zeolites used in the second stage are crystalline aluminosilicate zeolites having a silica to alumina mole ratio greater than about 10:1 and preferably from 70:1 to 250:1. These zeolites have useful activity even at high silica to alumina mole ratios such as 1000:1 to 2000:1.

As used herein, "intermediate pore size" means an effective pore aperture in the range of about 5 to 6.5 Angstroms when the zeolite is in the acid form [H form]. Zeolites having pore apertures in this range tend to have unique molecular sieving characteristics. Unlike small pore zeolites, such as erionite, they will allow hydrocarbons having some branching into the zeolitic void spaces.

The effective pore size of the zeolites can be measured using standard adsorption techniques and hydrocarbonaceous compounds of known minimum kinetic diameters. See Breck, *Zeolite Molecular Sieves,* 1974 (especially Chapter 8) and Anderson et al., *J. Catalysis* 58, 114 (1979), both of which are incorporated by reference.

Intermediate pore size zeolites in the acid form will typically admit molecules having kinetic diameters of 5 to 6 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular zeolite, but do not penetrate as quickly and in some cases, are effectively excluded (for example, 2,2-dimethylbutane is excluded from H-ZSM-5). Compounds having kinetic diameters in the range of 6 to 6.5 Angstroms include: cyclohexane (6.0), 2,3-dimethylbutane (6.1), 2,2-dimethylbutane (6.2), m-xylene (6.1), and 1,2,3,4-tetramethylbenzene (6.4). Generally, compounds having kinetic diameters of greater than about 6.5 Angstroms cannot penetrate the pore apertures and thus cannot be adsorbed in the interior of the zeolite. Examples of such larger compounds include: o-xylene (6.8), hexamethylbenzene (7.1), 1,3,5-trimethylbenzene (7.5), and tributylamine (8.1).

The preferred effective pore size range is from about 5.3 to about 6.2 Angstroms. ZSM-5, ZSM-11, ZSM-12, silicalite, and mixtures thereof, for example, fall within this range.

In performing adsorption measurements to determine pore size, standard techniques are used. It is convenient to consider a particular molecule as excluded if it does not reach at least 95% of its equilibrium adsorption value on the zeolite in less than about 10 minutes (P/Po=0.5, 25° C.).

Examples of intermediate pore size zeolites include silicalite and members of the ZSM series, such as ZSM-5, ZSM-11, ZSM-12, ZSM-21, ZSM-23, ZSM-35, and ZSM-38. ZSM-5 is described in U.S. Pat. Nos. 3,702,886 and 3,770,614; ZSM-11 is described in U.S. Pat. No. 3,709,979; ZSM-12 is described in U.S. Pat. No. 3,832,449; ZSM-21 is described in U.S. Pat. No. 3,948,758; and silicalite is described in U.S. Pat. No. 4,061,724. These patents are incorporated by reference. The preferred zeolites are ZSM-5, silicalite, ZSM-11, and mixtures thereof. The intermediate pore size zeolite can be bound using conventional binders.

In addition, in its most preferred form, the zeolite is impregnated with a modifier, such as magnesium, calcium, barium, or phosphorus, preferably magnesium or phosphorus. In its preferred form, the zeolite is impregnated with magnesium and the concentration may vary from 0.1 to 10 wt. %, but preferably varies from 1 to 8%, most preferably 2 to 5%. These elements neutralize or moderate the acidity of the zeolite as well as impart some shape selectivity to the zeolite.

ISOMERIZATION CONDITIONS

In the present invention, the reformate is contacted with an intermediate pore size zeolite at a temperature that is the same as that at the exit of the first stage, a pressure of from 1 atmosphere to 500 psig, a WHSV of from 5 to 10 based on the zeolite, and a $H_2$/HC mole ratio of from 1:1 to 10:1. Preferably, the reformate is contacted at a pressure of 75–100 psig, a WHSV of from 5 to 10 based on the zeolite, and a $H_2$/HC mole ratio of from 2:1 to 5:1.

EXAMPLES

The invention will be further illustrated by following examples, which set forth particularly advantageous method embodiments. While the Examples are provided to illustrate the present invention, they are not intended to limit it.

CATALYST PREPARATION EXAMPLES

The following two examples describe how the catalysts used in this application were prepared.

CATALYST 1

This example describes how a 2.4 wt % Mg/ZSM-5 second-stage catalyst was prepared. The ZSM-5 in the acid form was obtained from PQ Corporation. The zeolite was characterized by a silica/alumina (SAR) ratio of about 80. Its crystallite size was 0.2 microns or less as measured by transmission electron microscopy (TEM). The zeolite was calcined at 1000° F. for ten hours then cooled in a dessicator prior to use. Water absorptivity of the powder was measured at 0.74 cc/g. 3.12 grams of magnesium nitrate hexahydrate (Baker, assay 98.2%) were dissolved in deionized water to a total volume of 8.0 cc. The solution was added to twelve grams of the zeolite to impregnate the zeolite with magnesium (Mg). The resulting catalyst was dried overnight at 120° C. and then calcined at 500° C. (932° F.) overnight. The resulting powder was formed into cylinders by using a 0.5 inch diameter die and a hydraulic press. The powder was held at 11,000 psig for one minute. The cylinders were broken and sieved to 20–40 mesh (U.S. Standard Sieve).

CATALYST 2

This example describes the preparation of a Pt/Mg-ZSM-5 second-stage catalyst. Ten grams of Mg-ZSM-5 from Catalyst 1 were placed in a plastic bottle and 80 cc. of deionized water was added to the powder. The mixture was placed in a constant temperature shaker bath held at 30° C. and agitated at 150 rpm. 0.0178 grams of platinum tetramine dichloride were dissolved in 30 cc. of deionized water and then added to the Mg-ZSM-5 slurry. Mixing of the whole mixture was continued for 24 hours. It was then filtered to recover the solid, which was then dried at 120° C. for eight hours. The dried solid was then calcined at 550° F. for three hours. The catalyst was then formed into cylinders and then to a 20–40 mesh size as in Catalyst Example 1.

FEED NAPHTHA COMPOSITION

The feed used in the following examples is a wide-boiling range Arabian straight-run naphtha, which was hydrofined to reduce sulfur to acceptable levels. The properties of this naphtha are shown in the following Table:

C6–C10 Arabian Straight Run Naphtha

| ASTM D 86, LV % | ° F. |
|---|---|
| St | 145 |
| 10 | 184 |
| 30 | 198 |
| 50 | 219 |
| 70 | 243 |
| 90 | 262 |
| EP | 295 |
| Gravity, ° API | 65.8 |
| Carbon No. Distribution - wt % | |
| $C_5$ | 1.8 |
| $C_6$ | 27.72 |
| $C_7$ | 22.69 |
| $C_8$ | 33.77 |
| $C_9$ | 13.29 |
| $C_{10}$ | 0.72 |
| PNA - wt % | |
| Paraffins (n + i) | 72.32 |
| Naphthenes | 17.67 |
| Aromatics | 9.37 |
| Unknown | 0.64 |
| Total | 100.00 |

The following examples describe the uses of the present invention.

COMPARATIVE EXAMPLE A

Ten cubic centimeters of 1/16 inch 0.6% Pt/K-Ba L Zeolite extrudate, a non-acidic aromatization catalyst, were crushed to a size of 20–40 mesh (U.S. Standard Sieve). Two cubic centimeters of the 20–40 mesh catalyst was charged to a ¼" reactor diameter. Since the non-acidic L Zeolite catalyst is sensitive to sulfur, a one cubic centimeter bed of SCG, a K/Alumina sulfur removal catalyst, was placed above the L Zeolite catalyst to reduce the sulfur content of the feed to below 50 ppb. A $C_6$–$C_9$ wide boiling range Arabian straight run naphtha, whose composition is shown above, was passed over the non-acidic aromatization catalyst to produce benzene, toluene, $C_8$ and $C_{9+}$ aromatics. Operating conditions were a pressure of 75 psig, 1 LHSV,and a hydrogen/hydrocarbon mole ratio of 5:1 moles/mole. The reactor temperature was adjusted to achieve an aromatics concentration of 83 wt % in the $C_{5+}$ material. This equates to a yield of about 73 wt % as a weight percent of feed or about 76 wt % aromatics on a hydrocarbon basis in the reactor effluent. Results are shown in the following Table:

| | |
|---|---|
| Pressure - PSIG | 75 |
| LHSV - $hr^{-1}$ | 1 |
| Hydrogen/Hydrocabon - mole/mole | 5 |
| Temperature - F. | 908 |
| Reactor Effluent Analysis - wt % OF Feed | |
| Hydrogen | 3.47 |
| Methane | 4.28 |
| Ethane | 1.64 |
| Propane | 1.21 |
| Butanes | 1.01 |
| Other Paraffins + Naphthenes | 15.04 |
| Benzene | 22.16 |
| Toluene | 26.06 |
| EB | 6.31 |
| Xylenes | 13.41 |
| $C_{9+}$ Aromatics | 5.41 |
| Total | 100.00 |
| Total Aromatics | 73.36 |
| $C_8$ Aromatics Distribution - Wt % | |
| EB | 32.01 |
| Xylenes | 67.99 |
| Xylenes Distribution - Wt % | |
| PX | 12.0 |
| MX | 39.6 |
| OX | 48.4 |

These results show that when using a non-acidic aromatization catalyst to make $C_8$ aromatics, the resulting $C_8$ aromatics have a high concentration of ethylbenzene (EB), namely 32 wt % (on a $C_8$ aromatics basis) in this case, and the xylenes distribution shows a below-equilibrium concentration of para-xylene (PX) on a xylene basis. In this case 12 wt % PX. The equilibrium concentration of PX at 908° F. is 23.2 wt % on a xylene basis. Note the high concentration of both benzene and toluene.

COMPARATIVE EXAMPLE B

This example shows the $C_8$ aromatics distribution and xylene distribution obtained with a standard acidic bimetallic aromatization catalyst. Two cubic centimeters of 20–40 mesh of a chlorided Pt/Sn on alumina catalyst were charged to a ¼" diameter reactor. The same feed as used in Comparative Example A was passed over the catalyst at the same operating conditions, except that the reactor temperature was established to achieve a yield of aromatics of 48.9 wt % of feed. The $C_{5+}$ liquid product had a gas chromatographic based Research Octane Number of 87.4. The results are as shown in the following Table:

| | |
|---|---|
| Pressure - PSIG | 75 |
| LHSV - $hr^{-1}$ | 1 |
| Hydrogen/Hydrocabon - mole/mole | 5 |
| Temperature - F. | 897 |
| Reactor Effluent Analysis - Wt % Of Feed | |
| Hydrogen | 1.74 |
| Methane | 0.64 |
| Ethane | 1.67 |
| Propane | 3.11 |
| Butanes | 4.49 |
| Other Paraffins + Naphthenes | 39.45 |
| Benzene | 4.37 |
| Toluene | 10.84 |
| EB | 3.83 |
| Xylenes | 18.56 |
| $C_{9+}$ Aromatics | 11.30 |
| Total | 100.00 |
| Total Aromatics | 48.91 |
| $C_8$ aromatics Distribution - Wt % | |
| EB | 17.11 |
| Xylenes | 82.89 |
| Xylenes Distribution - Wt % | |
| PX | 21.0 |
| MX | 44.9 |
| OX | 34.1 |

Note that the acidic aromatization catalyst resulted in a $C_8$ aromatics make low in ethylbenzene, i.e. 17.11 wt %, compared to 32.01 wt % with the non-acidic catalyst. In addition the xylenes distribution showed a much higher concentration of PX and one that was close to equilibrium. At 897° F. the equilibrium concentration of PX on a xylenes basis is 23.2 wt %. However, it should also be noted that the maximum aromatics make with this catalyst was about 60 wt % of feed, substantially lower than the 73.36 wt % of feed obtained in Comparative Example A with the non-acidic aromatization catalyst. While the xylenes make was higher, the benzene and toluene make was much lower.

COMPARATIVE EXAMPLE C

A two-stage catalytic reactor system was tested to reduce the EB content of the effluent stream from an aromatizer where the aromatization catalyst was a non-acidic zeolite and to isomerize the xylenes to equilibrium. Two cubic centimeters of 20–40 mesh 0.6% Pt/K-Ba L Zeolite and 0.25 cubic centimeters of acidic 0.1% Pt-ZSM-5 were charged to a ¼" reactor diameter. In addition, one cubic centimeter of the sulfur removal catalyst, SCG, was placed on top of the L Zeolite catalyst. The first-stage catalyst was the non-acidic aromatization catalyst and the second stage catalyst was the Pt-ZSM-5 catalyst. The first and second-stage catalyst were separated by a 1-inch bed of alundum, which is an inert material. The Pt was loaded on the acid version of the ZSM-5 (HZSM-5) by ion-exchange. The silica/alumina mole ratio of the ZSM-5 zeolite was 80:1. The crystal size was 0.2 microns. The same naphtha as described above was processed over the first-stage catalyst and the resulting effluent was immediately processed over the second-stage catalyst. Operating conditions were the same as in Comparative Example A. The LHSV being 1 $hr^{-1}$ on the basis of the first stage catalyst. The WHSV for the second stage catalyst was 8.2. The results obtained with this catalyst system are shown in the following Table:

| | |
|---|---|
| Pressure - PSIG | 75 |
| LHSV - hr−1 | 1 |
| Hydrogen/Hydrocabon - mole/mole | 5 |
| Temperature - F. | 785 |
| Reactor Effluent Analysis - Wt % Of Feed | |
| Hydrogen | — |
| Methane | 2.59 |
| Ethane | 7.59 |
| Propane | 34.56 |
| Butanes | 16.55 |
| Other Paraffins + Naphthenes | 6.68 |
| Benzene | 8.18 |
| Toluene | 12.91 |
| EB | 0.03 |
| Xylenes | 9.23 |
| $C^{9+}$ Aromatics | 1.69 |
| Total | 100.00 |
| Total Aromatics | 32.04 |
| $C_8$ aromatics Distribution - Wt % | |
| EB | 0.32 |
| Xylenes | 99.68 |
| Xylenes Distribution - Wt % | |
| PX | 23.6 |
| MX | 51.4 |
| OX | 25.0 |
| EB Conversion(1) - % | 99.52 |
| Xylene Loss(1) - % | 30.05 |
| EB Conv./Xylene Loss Ratio(1) | 3.31 |
| Benzene Make(1) - % | Loss |

(1)These results are relative to the results shown in Comparative Example A.

The results of Comparative Example C, when compared to the base case Comparative Example A, show that a substantial amount of the aromatics produced in the first stage was lost in the second stage by conversion to essentially propane via hydrogenolysis in spite of the lower reactor temperature. This across the board loss in aromatics via hydrogenation and cracking was due to the Pt function and the acidity respectively of the ZSM-5 zeolite. The Pt provided a hydrogenation-dehydrogenation function while the acidity of the ZSM-5 provided the cracking activity. The xylene loss was very high at 30% and EB conversion to light ends was also high, at 99.5%. Note that the xylenes which were not at equilibrium (see the PX concentration in Comparative Example A) as they exit the first stage were at equilibrium at the exit of the second-stage catalyst. The equilibrium concentration of PX on a xylene basis at 785° F. is 23.5 wt %.

COMPARATIVE EXAMPLE D

The two-stage catalytic reactor system experiment was repeated, but this time the second-stage catalyst was the same ZSM-5 zeolite as in Comparative Example C, except that the ZSM-5 zeolite was impregnated with Magnesium (Mg), after which Pt was added by ion-exchange as described in Catalyst 2. The ZSM-5 catalyst contained 2.4% Mg by weight and 0.1 wt % Pt (0.1% Pt/2.4%Mg/ZSM-5). The ZSM-5 was the same as used in Comparative Example C in terms of silica/alumina mole ratio and crystal size. The same catalyst quantities were used for the first and second-stage as in Comparative Example C as well as the same operating conditions. The results are shown in the following Table:

| | |
|---|---|
| Pressure - PSIG | 75 |
| LHSV - hr−1 | 1 |
| Hydrogen/Hydrocabon - mole/mole | 5 |
| Temperature - F. | 826 |
| Reactor Effluent Analysis - Wt % Of Feed | |
| Hydrogen | 0.74 |
| Methane | 2.98 |
| Ethane | 4.29 |
| Propane | 20.07 |
| Butanes | 14.03 |
| Other Paraffins + Naphthenes | 6.79 |
| Benzene | 14.81 |
| Toluene | 19.70 |
| EB | 0.78 |
| Xylenes | 12.66 |
| $C_{9+}$ Aromatics | 3.15 |
| Total | 100.00 |
| Total Aromatics | 51.10 |
| $C_8$ aromatics Distribution - Wt % | |
| EB | 5.80 |
| Xylenes | 94.20 |
| Xylenes Distribution - Wt % | |
| PX | 23.9 |
| MX | 52.3 |
| OX | 23.8 |
| EB Conversion(1) - % | 87.57 |
| Xylene Loss(1) - % | 5.62 |
| EB Conv./Xylene Loss Ratio(1) | 15.58 |
| Benzene Make(1) - % | Loss |

(1)These results are relative to the results shown in Comparative Example A.

The overall aromatics make increased relative to Comparative Example C by nearly a factor of two but still was not comparable to the aromatics make in Comparative Example A. Addition of Magnesium reduced the acidity of the ZSM-5 catalyst, thereby reducing it's cracking activity. This in turn reduced the amount of aromatics lost due to hydrogenolysis/cracking, as evidenced by a propane make of ~20 wt % compared to ~34.6 wt % in Comparative Example C. The xylene loss relative to Comparative Example A was 5.6%, a substantial reduction for Comparative Example D, and the EB conversion to light ends was 87.6%. Again, the xylenes at the exit of the second-stage catalyst were at equilibrium. The equilibrium concentration of PX on a xylene basis at 826° F. is 23.4 wt %. In this example, the PX concentration on a xylenes basis in the effluent from the second-stage was at 102.1% of the equilibrium value. The Mg in the ZSM-5 imparted some paraselectivity to the zeolite.

EXAMPLE 1

Comparative Example D was repeated, however the ZSM-5 was impregnated with 2.4 wt % Mg and no Pt was added to the ZSM-5. The catalyst preparation is explained in greater detail in Catalyst 1. Operating conditions were the same as in in Comparative Example D. The results are shown in the following Table:

| | |
|---|---|
| Pressure - PSIG | 75 |
| LHSV - $hr^{-1}$ | 1 |
| Hydrogen/Hydrocabon - mole/mole | 5 |
| Temperature - F. | 882 |
| Reactor Effluent Analysis - Wt % Of Feed | |
| Hydrogen | 3.16 |
| Methane | 4.55 |
| Ethane | 2.68 |
| Propane | 2.90 |
| Butanes | 1.44 |
| Other Paraffins + Naphthenes | 14.63 |
| Benzene | 24.50 |
| Toluene | 25.60 |
| EB | 2.96 |
| Xylenes | 12.83 |
| $C_{9+}$ Aromatics | 4.75 |
| Total | 100.00 |
| Total Aromatics | 70.65 |
| $C_8$ aromatics Distribution - Wt % | |
| EB | 18.76 |
| Xylenes | 81.24 |
| Xylenes Distribution - Wt % | |
| PX | 23.9 |
| MX | 51.9 |
| OX | 24.2 |
| EB Conversion(1) - % | 53.04 |
| Xylene Loss(1) - % | 4.31 |
| EB Conv./Xylene Loss Ratio(1) | 12.30 |
| Benzene Make(1) - % | 10.56 |

(1)These results are relative to the results shown in Comparative Example A.

With the elimination of Pt, the light ends make from the second-stage, and in particular the propane make, was substantially reduced and was just slightly higher than that in Comparative Example A, which is the reference case with the single-stage non-acidic aromatization catalyst. Note that the total aromatics make of 70.65 wt % is only 3.7% less than in Comparative Example A. The EB conversion was 53%. The benzene concentration in the effluent from the second-stage increased by 10.6% relative to Comparative Example A. This indicates that the EB was hydrodealkylated to benzene and ethane, as opposed to being destroyed to light ends as in the previous examples. The xylene loss was small at 4.3% resulting in an EB conversion to xylene loss ratio of 12.3:1. The xylenes exiting the second-stage catalyst were at equilibrium. The equilibrium concentration of PX on a xylene basis at 882° F. is 23.3 wt %. In this example, the PX concentration on a xylene basis in the effluent from the second-stage was at 102.5% of the equilibrium value. Again, this above equilibrium concentration of PX is due to the Mg in the ZSM-5.

EXAMPLE 2

Example 1 was repeated with the same ZSM-5, except that the Mg content of the ZSM-5 was 4.0 wt %. This second-stage catalyst gave results which are somewhat better than those of Example 1. The EB conversion was slightly lower at 49.8% and the xylene losses were quite a bit lower at 2.3%, resulting in an EB conversion to xylene loss ration of 21.5:1 compared to 12.3:1 in Example 1. This means that the catalyst of this example was slightly more selective from a xylenes standpoint than the catalyst of Example 1. As in Example 1, benzene was produced in the second -stage as indicated by an increase of 9.7% in the concentration of benzene in the effluent from the second-stage as compared to the effluent from Comparative Example A. The EB was converted by hydro-dealkylation to benzene and ethane. In addition, the xylenes were isomerized to equilibrium. The results are shown in the following Table:

| | |
|---|---|
| Pressure - PSIG | 75 |
| LHSV - $hr^{-1}$ | 1 |
| Hydrogen/Hydrocabon - mole/mole | 5 |
| Temperature - F. | 879 |
| Reactor Effluent Analysis - Wt % Of Feed | |
| Hydrogen | 3.19 |
| Methane | 4.43 |
| Ethane | 2.59 |
| Propane | 2.76 |
| Butanes | 1.39 |
| Other Paraffins + Naphthenes | 14.87 |
| Benzene | 24.31 |
| Toluene | 25.48 |
| EB | 3.17 |
| Xylenes | 13.10 |
| $C_{9+}$ Aromatics | 4.71 |
| Total | 100.00 |
| Total Aromatics | 70.77 |
| $C_8$ aromatics Distribution - Wt % | |
| EB | 19.46 |
| Xylenes | 80.54 |
| Xylenes Distribution - Wt % | |
| PX | 23.0 |
| MX | 48.2 |
| OX | 28.8 |
| EB Conversion(1) - % | 49.83 |
| Xylene Loss(1) - % | 2.32 |
| EB Conv./Xylene Loss Ratio(1) | 21.45 |
| Benzene Make(1) - % | 9.70 |

(1)These results are relative to the results shown in Comparative Example A.

EXAMPLE 3

Example 2 was repeated, but this time the ZSM-5 zeolite was impregnated with Phosphorus (P) to obtain 1.7% P by weight. The catalyst preparation was similar to that described in Catalyst 1 except that diammonium hydrogen phosphate was used as the source of phosphorus. The operating conditions were the same as in Example 2. The second-stage catalyst gave results similar to those in Example 2, except that a much higher operating temperature (923° F. versus 879° F.) was required to achieve a slightly lower EB conversion, 44.0% versus 49.8%. EB conversion was by hydro-dealkylation as evidenced by a 7.4% increase in the benzene make relative to Comparative Example A. The xylenes from the first-stage were isomerized to equilibrium. The concentration of PX in the second-stage effluent was 23.7% on a xylenes basis compared to 23.2% at equilibrium. Here also, the P imparted some para-selectivity to the zeoilte as the PX concentration is 102.1% of the equilibrium value. The results are shown in the following Table:

| | |
|---|---|
| Pressure - PSIG | 75 |
| LHSV - hr−1 | 1 |
| Hydrogen/Hydrocabon - mole/mole | 5 |
| Temperature - F. | 923 |
| Reactor Effluent Analysis - Wt % Of Feed | |
| Hydrogen | 3.17 |
| Methane | 4.34 |
| Ethane | 2.07 |
| Propane | 1.65 |
| Butanes | 1.37 |
| Other Paraffins + Naphthenes | 14.87 |
| Benzene | 23.80 |
| Toluene | 24.41 |
| EB | 3.53 |
| Xylenes | 13.26 |
| $C_{9+}$ Aromatics | 5.83 |
| Total | 100.00 |
| Total Aromatics | 70.83 |
| $C_8$ aromatics Distribution - Wt % | |
| EB | 21.02 |
| Xylenes | 78.98 |
| Xylenes Distribution - Wt % | |
| PX | 23.7 |
| MX | 51.2 |
| OX | 25.1 |
| EB Conversion(1) - % | 43.99 |
| Xylene Loss(1) - % | 1.15 |
| EB Conv./Xylene Loss Ratio(1) | 38.38 |
| Benzene Make(1) - % | 7.41 |

(1)These results are relative to the results shown in Comparative Example A.

While the present invention has been described with reference to specific embodiments, this application is intended to cover those various changes and substitutions that may be made by those skilled in the art without departing from the spirit and scope of the appended claims.

What is claimed is:

1. A process for reforming a hydrocarbon feed comprising:

(a) reacting the hydrocarbon feed at elevated temperatures in the presence of hydrogen, using a non-acidic catalyst comprising at least one Group VIII metal on an inorganic support to produce a reformate stream containing ethylbenzene and xylenes in which the para-xylene content of the xylene fraction is less than equilibrium, and (b) reacting at least some of said reformate at elevated temperatures in the presence of hydrogen, using an isomerization catalyst comprising a modifier on an intermediate pore size zeolitic support, the zeolitic support having a zeolite crystal size of 0.2 micron or less, to isomerize the non-equilibrium xylene fraction, wherein the modifier is selected from the group consisting of magnesium, calcium, barium, and phosphorus; and wherein at least 20 wt. % of the ethylbenzene in the reformate is converted by hydrodealkylation.

2. A process for reforming a hydrocarbon feed to enhance para-xylene yield and to minimize ethylbenzene production, said process comprising:

(a) reacting the hydrocarbon feed at elevated temperatures in the presence of hydrogen, using a non-acidic catalyst comprising at least one Group VIII metal on a non-acidic zeolite support, to produce a reformate stream containing ethylbenzene and xylenes in which the para-xylene content of the xylene fraction is less than equilibrium, and (b) reacting at least some of said reformate at elevated temperatures in the presence of hydrogen, using an isomerization catalyst comprising a modifier on an intermediate pore size zeolitic support, the zeolitic support having a zeolite crystal size of 0.2 micron or less, in the absence of a Group VIII metal, to isomerize the non-equilibrium xylene fraction; wherein the modifier is selected from the group consisting of magnesium, calcium, barium, and phosphorus; and wherein at least 20 wt. % the ethylbenzene in the reformate is converted by hydrodealkylation.

3. A process for reforming according to claim 2 wherein the non-acidic catalyst comprises platinum on a non-acidic potassium zeolite L.

4. A process for reforming according to claim 2 wherein the intermediate pore size zeolitic support is selected from the group consisting of ZSM-5, ZSM-11, ZSM-12, silicalite, and mixtures thereof.

5. A process for reforming according to claim 4 wherein the intermediate pore size zeolitic support is ZSM-5.

6. A process for reforming according to claim 4 wherein the modifier is selected from the group consisting of magnesium and phosphorus.

7. A process for reforming according to claim 6 wherein the modifier is magnesium.

8. A process for reforming according to claim 2 wherein the reaction of step (a) is carried out at a temperature of 400° C. to 600° C., a pressure of from 1 atmosphere to 500 psig, a LHSV of from 0.3 to 5, and a $H_2$/HC mole ratio of from 1:1 to 10:1; and wherein the reaction of step (b) is carried out at a temperature of 400° C. to 600° C., a pressure of from 1 atmosphere to 500 psig, a WHSV of from 5 to 10, and a $H_2$/HC mole ratio of from 1:1 to 10:1.

9. A process for reforming a hydrocarbon feed to enhance para-xylene yield and to minimize ethylbenzene production, said process comprising:

(a) reacting the hydrocarbon feed in the presence of hydrogen at a temperature of 430° C. to 550° C., a pressure of from 75 to 100 psig, a LHSV of from 0.3 to 5, and a $H_2$/HC mole ratio of from 2:1 to 5:1, using a non-acidic catalyst comprising platinum on a non-acidic potassium zeolite L, to produce a reformate stream containing ethylbenzene and xylenes in which the para-xylene content of the xylene fraction is less than equilibrium, and (b) reacting at least some of said reformate in the presence of hydrogen at a temperature of 430° C. to 550° C., a pressure of from 75 to 100 psig, a WHSV of from 5 to 10, and a $H_2$/HC mole ratio of from 2:1 to 5:1, using an isomerization catalyst comprising magnesium on a ZSM-5 support in the absence of a Group VIII metal, to isomerize the non-equilibrium xylene fraction, and wherein at least 20 wt. % of the ethylbenzene in the reformate is converted by hydrodealkylation.

* * * * *